United States Patent [19]

Milliken

[11] 3,973,772

[45] Aug. 10, 1976

[54] TOY KARATE DEVICE

[76] Inventor: Paul E. Milliken, 9061 Wall St., NW., Massillon, Ohio 44646

[22] Filed: Mar. 3, 1975

[21] Appl. No.: 554,589

Related U.S. Application Data

[60] Division of Ser. No. 390,866, Aug. 23, 1973, Pat. No. 3,883,135, which is a continuation-in-part of Ser. No. 359,099, May 10, 1973, abandoned.

[52] U.S. Cl. ..... 272/76; 272/8 N

[51] Int. Cl.[2] ..... A63J 5/00

[58] Field of Search ..... 272/76, 155, 102 A, 272/102 AP, 8 R, 8 N, 27 R, 27 N; 46/26, 29, 1 R, 25, 17, 16, 24; 35/69, 73; 273/156, 160, 130 A, 131 A, 131 AC, 131 AD, 131 AE, 131 AB

[56] References Cited

UNITED STATES PATENTS

| | | | |
|---|---|---|---|
| 1,236,234 | 8/1917 | Troje | 46/24 |
| 1,620,574 | 3/1927 | Savage | 46/24 |
| 1,656,199 | 1/1928 | Hodgson | 46/24 |
| 1,895,611 | 1/1933 | Doak | 46/26 |
| 3,029,077 | 4/1962 | Benkoe | 273/105.4 UX |
| 3,518,786 | 7/1970 | Holtvoigt | 46/24 |
| 3,610,615 | 10/1971 | Clearly | 272/76 X |

*Primary Examiner*—Anton O. Oechsle
*Assistant Examiner*—T. Brown

[57] ABSTRACT

A toy karate device having a separable board made from two mating separable pieces held in end to end relationship. The board is provided with a support such as a block placed under each end. Each piece has an edge which mates with the edge of the other piece; each mating edge being irregular in the form of a series of longitudinally extending outwardly converging projections alternately defining therebetween inwardly converging depressions, the projections on one piece extending into the depressions of the opposite piece when the pieces are assembled together such that the projections of one piece overlaps the projections of the other piece, the configuration of the mated edges appearing as a broken board when the pieces are disassembled. Each irregular edge is provided with a retainer element which cooperates to releasably hold the two pieces together when the mating edges are mated; the cooperating retainer elements being releasable when the assembled board is struck in the center with a sharp blow while the board is lying horizontally on the blocks. The retainer is a yieldable material, or may be an adhesive or magnetic device.

13 Claims, 16 Drawing Figures

TOY KARATE DEVICE

This is a division of application Ser. No. 390,866 filed Aug. 23, 1973, now U.S. Pat. No. 3,883,135, which in turn is a continuation-in-part of application Ser. No. 359,099 filed May 10, 1973, now abandoned.

This invention relates to a toy karate board comprising a pair of separable mating elements connected together in end to end relationship to appear as one single board but which appear to break in two when struck by the hand to simulate a karate chop.

OBJECTS OF THE INVENTION

An object of this invention is to provide a toy karate board which can be easily broken by a young child but which gives the illusion that the child is performing an amazing feat of strength and skill.

Another object of this invention is to provide a two piece karate board which gives the illusion of being in one solid piece.

Another object of this invention is to provide a toy two piece karate board which is simple to manufacture and is easy to reassemble after it is broken in two.

A still further object of this invention is to provide a toy karate board which is durable and will withstand repeated separations of the two pieces without damage to the pieces.

These and other objects of the invention will become more fully apparent as the description proceeds in the following specification and the attached drawings.

DESCRIPTION OF THE PREFERRED EMBODIMENTS

Figure 1:
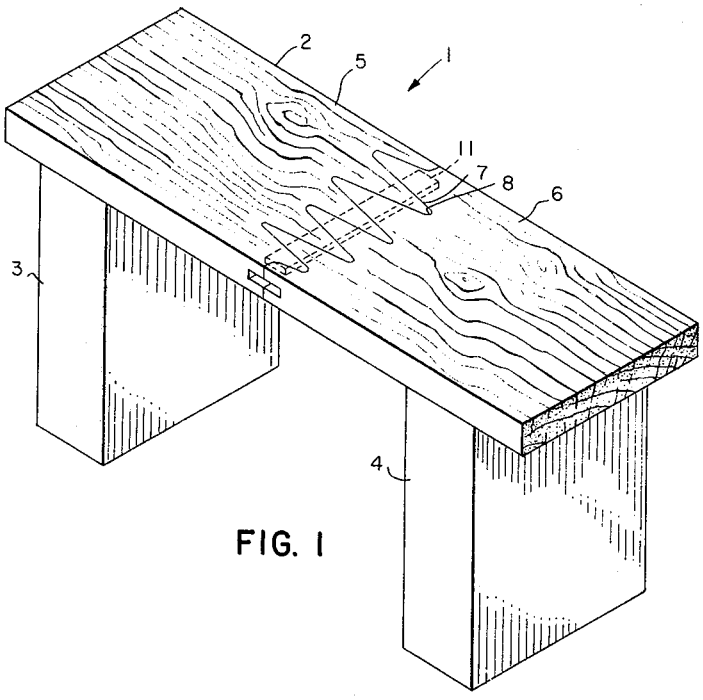
FIG. 1 is a perspective view of one embodiment of the invention in the assembled position ready for use.
Figure 2:
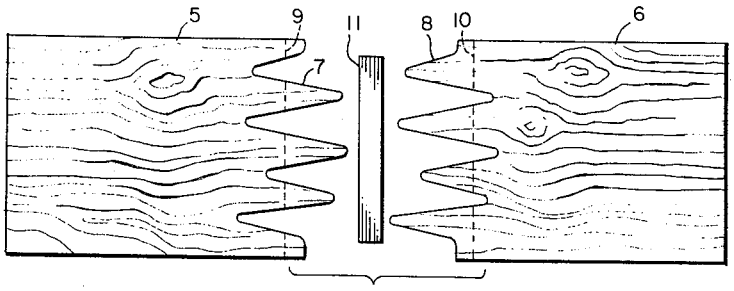
FIG. 2 is an exploded plan view of the board in the assembly of FIG. 1.
Figure 3:
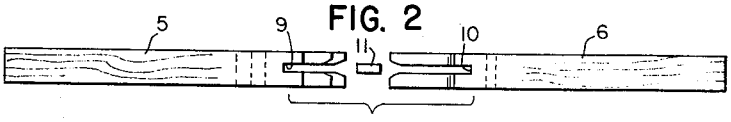
FIG. 3 is an exploded side elevational view of the board in FIG. 2.
Figure 4:
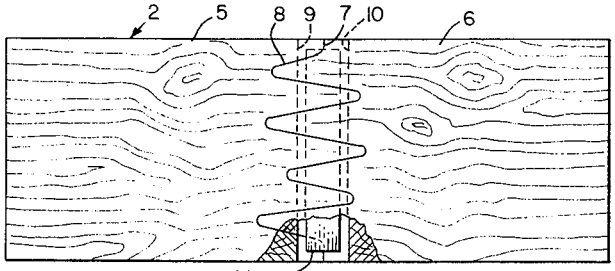
FIG. 4 is an assembled plan view of the board used in the assembly of FIG. 1 with a portion broken away to show the yieldable retainer which holds together the two pieces of the board.
Figure 5:
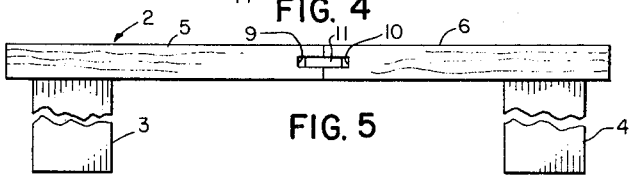
FIG. 5 is a side elevation of the board shown in FIG. 4 resting on supporting blocks.
Figure 9:
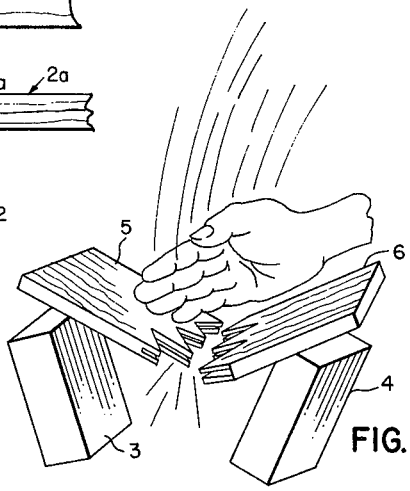
FIG. 9 is a perspective view of the embodiment in FIG. 1 with the board being struck with a hand to break it in two.

Referring now to FIG. 1 the entire assembly of the device is indicated by the numeral 1 and has a board 2 horizontally positioned with its opposite ends resting respectively on blocks 3 and 4 which in turn rest on a suitable surface. The board 2 is made up of two mating pieces 5 and 6 which fit together in end to end relationship. The adjoining ends 7 and 8 of pieces 5 and 6 are shaped in an irregular zig-zag contour which interfits with the contour of the end of the mating piece. Such a pair of mating pieces can easily be made by taking a single board and cutting it in two on a jig saw along an irregular zig-zag line. This assures two mating ends by a single cut. Transverse grooves or recesses 9 and 10 are cut in the ends 7 and 8 as shown in FIGS. 2 and 3. The grooves 9 and 10 are in alignment with each other so that a yieldable retainer strip 11 made of corrugated cardboard or other suitable material can be placed in the grooves 9 and 10 and the pieces 5 and 6 fitted together as shown in FIGS. 1, 4 and 5. The retainer strip 11 serves as a key to pass between the protruding portions of the ends 7 and 8 and temporarily lock together the pieces 5 and 6 to support the board 2 as though it were a solid unbroken piece when placed on the blocks 3 and 4 as shown in FIG. 1. The strip 11 is however, sufficiently yieldable that when the board 2 is struck with the hand in a karate chop the board comes apart as shown in FIG. 9 thereby simulating that the board is being broken for the first time. While various yieldable materials such as plastic, rubber or the like can be used to make the strip 11, corrugated cardboard has been found to be very effective and it has been found that cardboard will not break when the board is struck but often remains in one of the transverse slots or grooves 9 and 10 and a single cardboard strip can be reused many times before it is no longer sufficiently stiff to support the two pieces 5 and 6. Of course when the board 2 eventually starts to sag in the middle when placed on the blocks 3 and 4, it is then time to replace the cardboard with a new strip. A strip approximately ⅜ inch wide has been found to be satisfactory although this can vary some without affecting the operation of the board. Replacement strips can be easily cut from any standard corrugated cardboard box.

Figure 6:
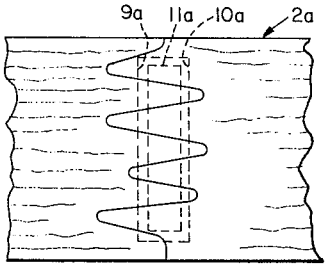
FIG. 6 is a fragmentary plan view of another embodiment of the invention.
Figure 7:
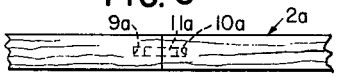
FIG. 7 is a fragmentary side elevational view of the embodiment in FIG. 6.

If it is desired that the grooves 9 and 10 not be seen at the side edges of the board, then they can be cut in such manner that they terminate short of the edge as do the grooves 9*a* and 10*a* in FIGS. 6 and 7. This provides a board in which both the grooves and the retainer 11*a* are hidden from view inside the board 2*a*.

Figure 8:
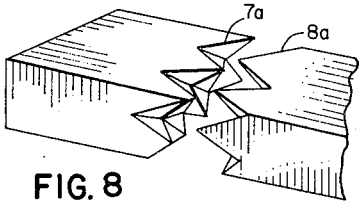
FIG. 8 is another embodiment of the invention showing a molded construction.

If the device is made from molded plastic as shown in FIG. 8 it is then possible to use a different mating edge configuration with mating ends 7*a* and 8*a* having three dimensional pyramidal protrusions and mating recesses. If the protrusions are of sufficient length to support the pieces on the blocks then a separate retainer such as 11 may not be needed. The molded device can be made in the form of a simulated board or it could be a brick or other object.

Figure 10:
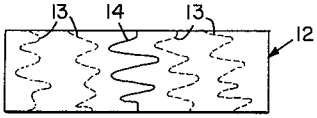
FIG. 10 is another embodiment of the invention in which the board has a pattern of irregular lines to conceal the line of separation between the two pieces of the board.

In FIG. 10 the board 12 is shown decorated with a series of irregular surface grooves 13 shown in dotted lines which tend to conceal the separation line 17.

Figure 11:
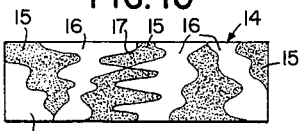
FIG. 11 is another embodiment of the invention in which to board has a pattern of irregular shapes of different colors to conceal the line of separation between to two pieces of the board.

While the embodiments in FIGS. 10 and 11 are desirable in that they conceal the separation line, making it diffucult to determine that the board is in two pieces, they would of course add to the production cost of the item and while the line of separation of the two pieces is visible in the embodiments shown in FIGS. 1 through 7, it is not particularly objectionable and is not readily noticeable when the pieces are fitted closely together.

One of the primary advantages of the embodiment in FIGS. 1 through 7 is its simplicity and ease of production and its durability even after repeated hard use.

The following alternative embodiments shown in FIGS. 12 through 16 and described hereafter are used on a pair of blocks such as 3 and 4 in FIG. 1 but for simplicity the blocks will not be shown with these embodiments. The main object of FIGS. 12 through 16 is to show different retaining means for fastening the two pieces together.

Figure 12:
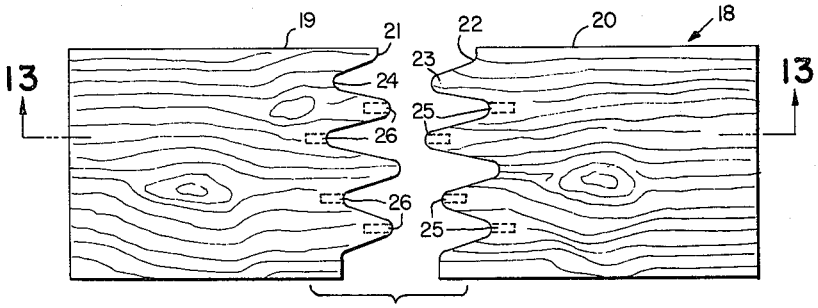
FIG. 12 is an exploded plan view of another embodiment of the invention.
Figure 13:
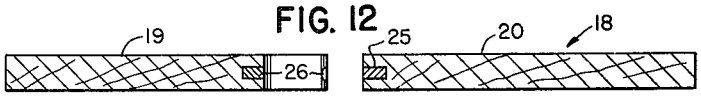
FIG. 13 is a cross-sectional view taken on line 13—13 of FIG. 12.

In FIGS. 12 and 13 a board 18 has two mating pieces 19 and 20 having respectively, mating edges 21 and 22 with fingerlike protrusions 23 and depressions 24. One or more magnets 25 of one polarity are positioned in the protrusions 23 and depressions 24 of piece 20. One or more magnets 26 of opposite polarity to the magnets 25 are positioned in the protrusions 23 and depressions 24 of the piece 19 so that when the pieces 19 and 20 are fitted in end to end relationship the magnets 25 are aligned with magnets 26. Since they are of opposite polarity they attract each other and hold the pieces 19 and 20 together until the board is struck with the hand as previously described with regard to the embodiment in FIG. 1. Instead of magnets with opposite polarity it is also possible to use magnets with pieces of metal such as iron which is attracted by a magnet with a positive polarity in the direction of the metal piece.

Figure 14:
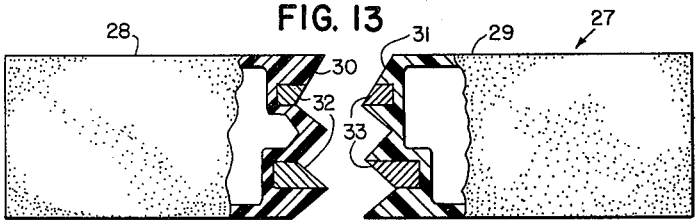
FIG. 14 is an exploded side view of another embodiment of the invention with portions broken away to show retainer magnets.

FIG. 14 shows how the two pieces may be molded of plastic to form a simulated brick 27 having mating pieces 28 and 29 with mating irregular edges 30 and 31 with magnets 32 and 33 respectively of opposite polarity to attract each other.

Figure 15:
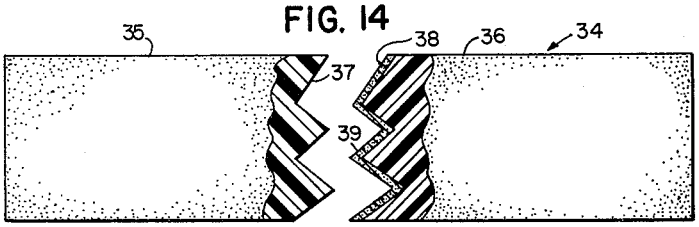
FIG. 15 is an exploded side view of another embodiment of the invention with portions broken away to show an adhesive layer on one of the pieces.

In FIG. 15 a plastic molded simulated brick 34 has two pieces 35 and 36 with mating irregular edges 37 and 38. A layer of adhesive 39 is located on the edge 38 to cause the pieces 35 and 36 to stick together when the ends are pushed together. A cooperative layer of adhesive may also be used on the edge 37 however, the adhesive must not secure the pieces 35 and 36 together so tightly that they will not separate when the brick is struck with the hand.

Figure 16:
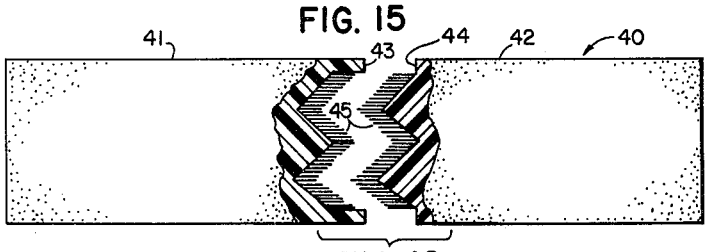
FIG. 16 is an exploded side view of another embodiment of the invention with portions broken away to show upstanding fibers on the ends of the pieces.

FIG. 16 shows a simulated brick 40 having two pieces 41 and 42 which respectively have mating edges 43 and 44 each of which has a layer of upstanding fibers 45 which interlock with each other when the end edges 43 and 44 are pushed together but which release the two pieces when the brick 40 is struck with the hand.

The simulated bricks 27, 34, and 40 shown in FIGS. 14 through 16 have been shown is side view only for simplicity. A plan view would be quite similar to the side views since the ends of the brick would have an irregular edge configuration similar to the brick in FIG. 8.

Thus it may be seen that various retaining devices may be used to temporarily fasten together the irregular edges of the two pieces of the board or brick until it is struck to break it in two.

Various other modifications can be made in the embodiments shown herein without departing from the scope of the invention.

I claim:

1. A toy karate device which can be reassembled repeatedly and rebroken to simulate the breaking of a solid continuous board with a human hand comprising:

A. a separable elongated horizontal member comprising a pair of mating pieces joined together in end to end relationship, each piece having an irregular edge which interfits with a similar irregular edge on the opposite piece, each of the irregular edges comprising a series of longitudinally extending outwardly converging projections alternately defining therebetween inwardly converging depressions, the projections of one piece extending into the depressions of the opposite piece when the pieces are assembled together, in such manner that the projections of one piece overlap the projections of the other piece in the longitudinal direction, the configuration of both irregular edges creating the visual appearance of the broken edges of an object that has been broken in two, when the two pieces are disassembled;

B. means supporting opposite ends of the separable member a spaced distance from a fixed surface;

C. first cooperative means attached to the irregular edge of one piece; and

D. second cooperative means attached to the irregular edge of the other piece;

E. said first and second cooperative means being of such construction that when placed in contact with each other they remain together and releasably attach the two mating pieces together;

F. said cooperative means being separable from each other when the separable member formed from the assembled mating pieces is struck a sharp blow;

G. each of said cooperative means having an outwardly facing surface which follows the contour of the adjacent portions of the irregular edge of the piece to which it is attached and of adjacent portions of the outwardly facing surface of the cooperative means attached to the opposite piece.

2. A toy karate device as claimed in claim 1 wherein the pair of mating pieces are molded plastic.

3. A toy karate device as claimed in claim 1 wherein the horizontal member has a decorative design on the surface to conceal a line of separation between the two mating pieces.

4. A simulated karate device as claimed in claim 1 wherein the retaining means is a magnetic device.

5. A simulated karate device as claimed in claim 1 wherein the retaining means is an adhesive layer.

6. A simulated karate device as claimed in claim 1 wherein the retaining means is a layer of upstanding fibers on each mating edge with each layer of fibers interfitting with the opposite layer of fibers when the pieces are pushed together in edge to edge relationship.

7. A simulated karate device comprising:

A. a separable element to be struck with a human hand;

B. said element comprising a pair of mating pieces, each piece having an irregular edge which interfits with a similar irregular edge on the opposite piece, each of the irregular edges comprising a series of longitudinally extending outwardly converging projections alternately defining therebetween, inwardly converging depressions, the projections of one piece extending into the depressions of the opposite piece when the pieces are assembled together, in such manner that the projections of one piece overlap the projections of the other piece in the longitudinal direction, the configuration of both irregular edges creating the visual appearance of the broken edges of an object that has been broken in two when the two pieces are disassembled; and C. retaining means permanently attached along at least one of the irregular edges to hold together the two pieces when placed in edge to edge relationship with each other but permitting separation of the two pieces when the separable element is struck with the hand to create the illusion of breaking a single continuous element, D. said retaining means having an outwardly facing surface which follows the contour of the adjacent portions of the irregular edge of the piece to which it is attached and adjacent portions of the mating irregular edge of the opposite piece.

8. A simulated karate device as claimed in claim 7 wherein the retaining means is a magnetic device.

9. A simulated karate device as claimed in claim 7 wherein the retaining means is an adhesive layer.

10. A simulated karate device as claimed in claim 7 wherein the retaining means is a layer of upstanding fibers on each mating edge with each layer of fibers interfitting with the opposite layer of fibers when the pieces are pushed together in edge to edge relationship.

11. A simulated karate device as claimed in claim 7 wherein the separable element is a simulated brick molded of plastic.

12. A simulated karate device as claimed in claim 7 including means supporting the separable element at each end in a horizontal position.

13. A simulated karate device as claimed in claim 12 wherein the supporting means comprises a block resting on a solid surface.

* * * * *